United States Patent [19]

Wallace

[11] 4,392,437

[45] Jul. 12, 1983

[54] FOLDABLE TABLE WITH FOLDABLE SUPPORT FRAME

[76] Inventor: John D. Wallace, 18 Cranbury Neck Rd., Cranbury, N.J. 08512

[21] Appl. No.: 226,880

[22] Filed: Jan. 21, 1981

[51] Int. Cl.[3] ..... A47B 3/00

[52] U.S. Cl. ..... 108/112; 108/129

[58] Field of Search ..... 108/112, 67, 32, 115, 108/129

[56] References Cited

U.S. PATENT DOCUMENTS

| | | | |
|---|---|---|---|
| 32,894 | 7/1861 | Rounds | 108/67 |
| 704,552 | 7/1902 | Lieske | 108/67 |
| 737,455 | 8/1903 | Noble . | |
| 1,405,362 | 1/1922 | Van Etten . | |
| 1,572,282 | 2/1926 | Grignon | 108/112 |
| 1,618,327 | 2/1927 | Dewey | 108/112 |
| 2,681,841 | 6/1954 | Sperry | 108/112 X |
| 2,750,243 | 6/1956 | Zielfeldt . | |
| 3,208,407 | 9/1965 | Maskew | 108/112 |
| 3,884,159 | 5/1975 | Faria | 108/112 |
| 3,993,003 | 11/1976 | James | 108/112 |
| 4,026,219 | 5/1977 | Shupe et al. | 108/112 |

*Primary Examiner*—Francis K. Zugel

*Attorney, Agent, or Firm*—Abraham Wilson

[57] ABSTRACT

A multiple-paneled folding tabletop is supported by two attached foldable subframes which interlock when unfolded and form a single frame supporting the tabletop by its perimeter. The tabletop consists of a series of rectangular panels attached to each other along their long edges by hinges. The direction of folding of the hinges alternates between panels. A subframe is affixed to each of the two end panels. The subframes include two swiveling bars which can move in a plane parallel to the unfolded tabletop. Each bar, when folded, is contained within a subframe and, when unfolded, spans the center panels and interlocks rigidly with the opposite subframe. Two foldable legs are attached to each subframe which, when folded, are contained within the subframes.

8 Claims, 9 Drawing Figures

FOLDABLE TABLE WITH FOLDABLE SUPPORT FRAME

BACKGROUND OF THE INVENTION

This invention relates to a folding assembly, such as a table, with a top desirably comprising a plurality of rectangular panels hinged together and which are held in their unfolded position by a swiveling bar or bars. The assembly as a table has individual folding legs which, in the folded position, are flat against the panels.

It is desirable for a folding table to have a large tabletop area relative to its folded size, along with light weight and substantial strength. It is also desirable that the legs be mounted near the outside corners of the structure for stability and that the number of legs be kept to a minimum, insuring simplicity and light weight.

Known tables of this type utilize a short swiveling bar or support which immobilizes two adjacent panels. The bar relies on the tabletop material to insure immobilization. (See U.S. Pat. Nos. 1,405,362 and 2,750,243)

The known tables have a large drawback in that the tabletop must be constructed of a material thick and strong enough to withstand the direct pressure of the bar and the bending moment of the swivel joint, thereby increasing the weight of the table. Additionally, when the table is bearing a load, the tabletop hinges must withstand considerable force.

Tables of prior design consisting of more than two panels or a central table with extensible or foldable leaves may be of two types. A first type requires that additional legs be added to the end panels. (See U.S. patent 737,455) This complicates the folding procedure and adds to the weight of the table. Additional legs may be needed in the center of the table lessening stability, i.e., increasing the possibility of wobble. (See U.S. Pat. No. 2,750,243) A second type of table with more than two panels includes a foldable or extensible panel which is cantilevered from a main panel which is supported by legs. Since the end panel is not supported by legs, the stability of the table is lessened. While the main portion of such a table can be very heavy, to improve the stability of the table, the added weight is undesirable from the point of mobility.

SUMMARY OF THE INVENTION

It is therefore an object of the present invention to provide a folding assembly for use, e.g., as part of a table, including a foldable tabletop, the construction of which allows for a tabletop made of thin, lightweight material while still retaining substantial rigidity and strength.

It is another object to minimize the folded size of the surface of the assembly relative to its unfolded size by utilizing foldable panels, desirably more than two, while retaining substantial stability and maintaining light weight and simplicity.

According to the present invention, a foldable assembly includes first and second foldably joined panels and at least one swivel bar member which spans between subassemblies attached to the panels to support the panels in an unfolded configuration.

In a preferred embodiment of the present invention a multiple-paneled folding tabletop is attached to two foldable subframes, each affixed to an end panel. The tabletop panels are attached to each other along their long edges by hinges which may, e.g., fold alternately in opposite directions. In its folded position, each subframe, in its two larger dimensions, is no larger than the tabletop panel to which it is fastened. Two foldable legs are attached to each subframe which, when folded, are contained within the subframe and are parallel with the tabletop. Two swiveling bars are included in the subframes, of which there are two possible configurations; either one swiveling bar in each subframe or both bars in one subframe. When the tabletop is unfolded, the bars swivel in a plane parallel to and a small distance from the tabletop and, in their unfolded position, span and support the center panels and lock the two subframes together. This creates a single frame which supports the tabletop by its perimeter, enabling lightweight material to be used for the tabletop. Each swiveling bar is held in place in its unfolded position by two C-shaped channels, one on each subframe, thus taking the bending moment off the swivel joint itself and distributing the load along the frame. A locking mechanism holds the bar immobile. To fold the table, the bars are unlocked and swiveled to their folded positions, said positions being within the dimensions of the end panels, and the legs are folded flat against the tabletop. This enables the panels to fold against one another, with the attached subframes on the outside of the folded assembly. An attached strap can be wrapped around the folded table and a retractable handle can be utilized for transportation of the folded table.

DETAILED DESCRIPTION OF THE DRAWING

Throughout the description the term "unfolded position" or "unfolded configuration" refers to the position the assembly or the part thereof is in when it is open and ready for use as a table.

Figure 1:
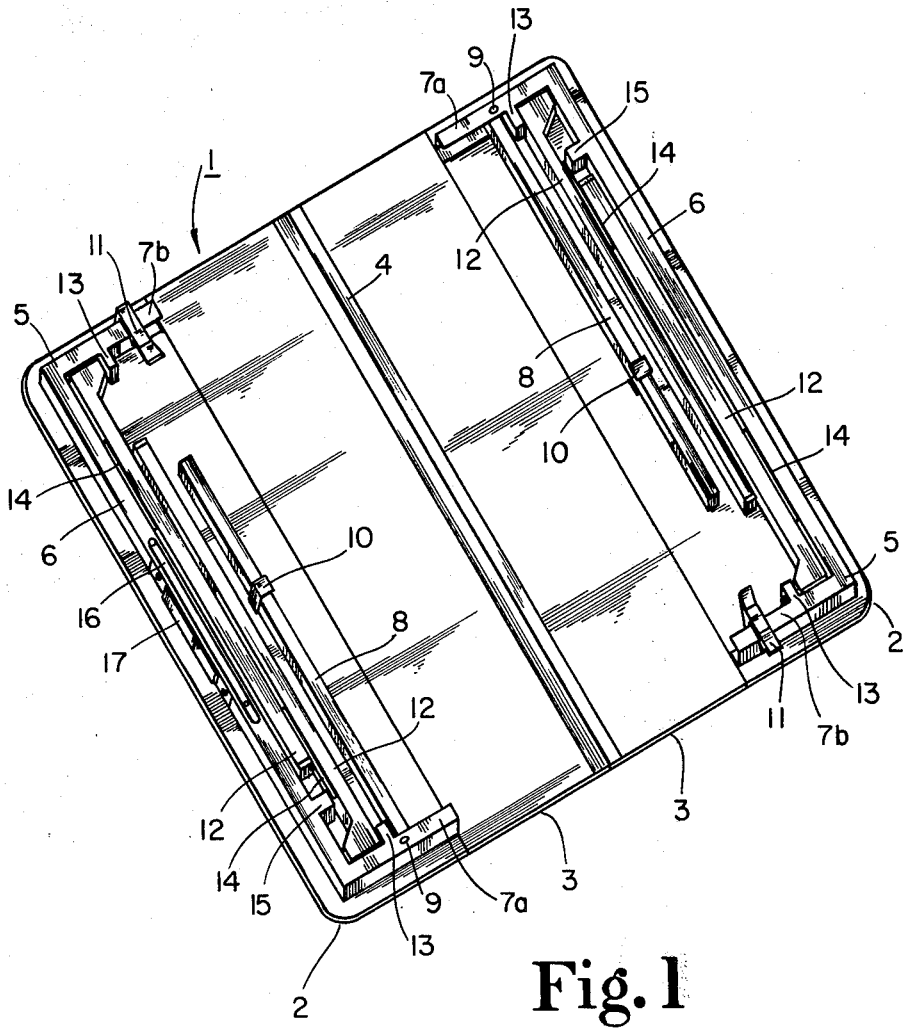
FIG. 1 is a perspective view of a folding table, constructed in accordance with the present invention, partially folded.
Figures 2A, 2B, 2C, 2D:
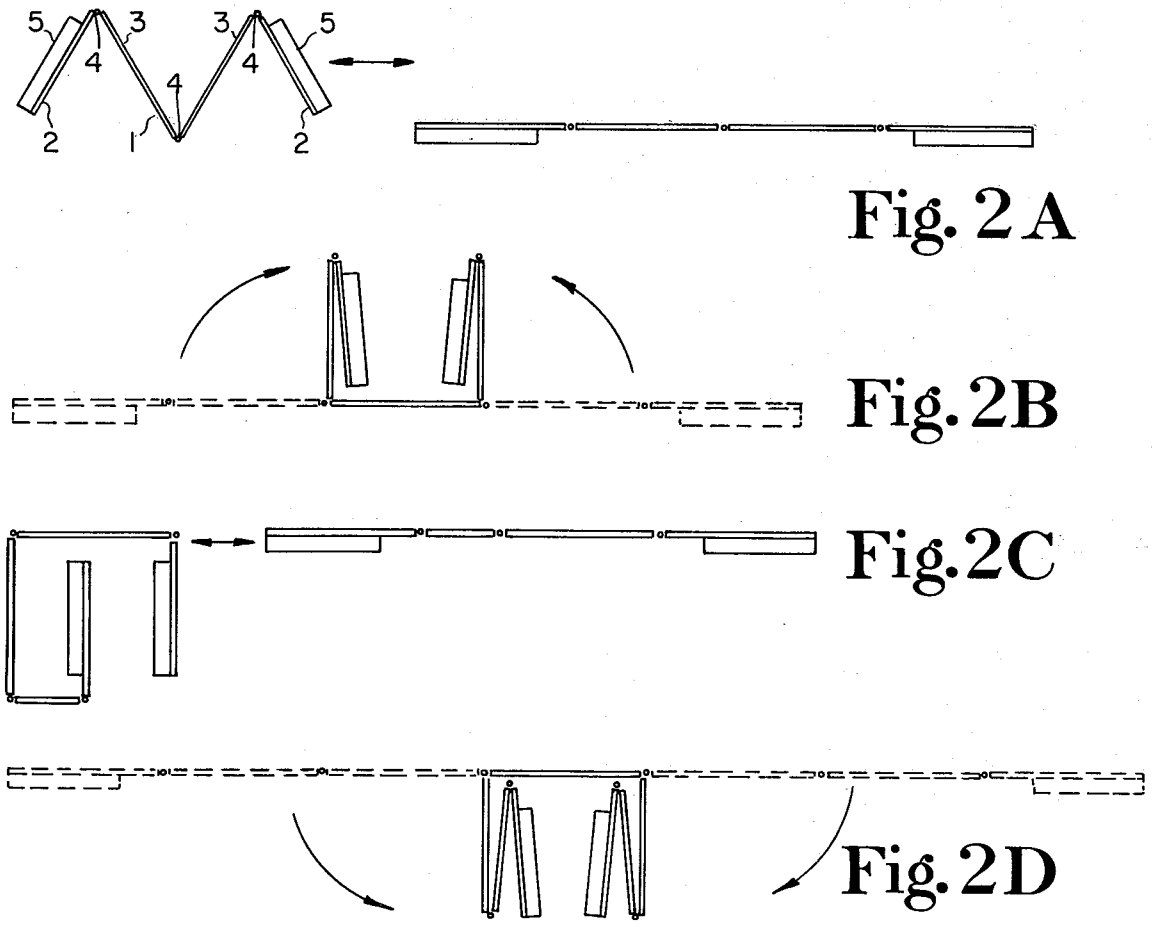
FIG. 2A is an end view of FIG. 1 showing, in schematic form, the tabletop in the process of folding.
FIGS. 2B–2D are side views showing, in schematic form, alternate manners in which panels of a foldable table, constructed according to the present invention, may be folded.

Referring to FIG. 1, a folding table in accordance with the present invention has a multiple-paneled folding tabletop 1 consisting of two end panels 2, and a number of center panels 3. These panels, approximately rectangular in shape, are attached to each other along their long edges by hinges 4, which can be made of a flexible material and are fastened along their long edges to the panels. These hinges fold alternately in opposite directions. This can best be seen in FIG. 2A.

Fastened to the end panels 2 are two subframes 5. Each subframe, in its two larger dimensions, is approximately the same size as or smaller than the panel it is affixed to. Each subframe consists of a tube 6 which follows at or near the edge of the end panel corresponding to opposite perimeter portions of the unfolded tabletop. Included in each subframe are two fixed sections of C-shaped channel 7a and 7b which follow the perimeter of the short end of the panels. The open sides of the channels face inward. Also included in the subframes are two swiveling bars 8 which are each attached by a pivot 9 to a subframe at a point inside the channel 7a. Each swiveling bar is restricted in movement approximately to a plane parallel to the unfolded tabletop by the C-shaped channels 7a.

Figure 3:
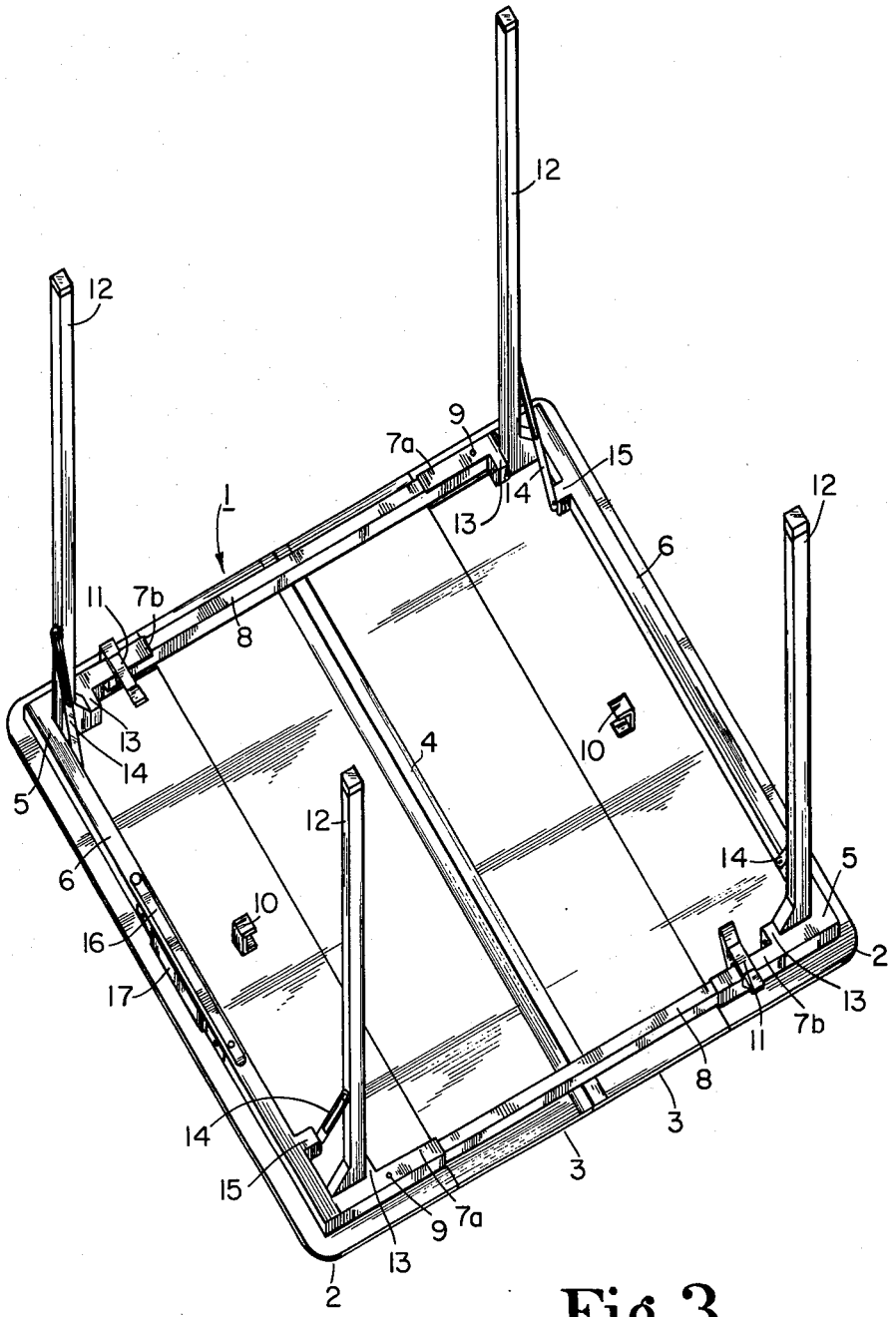
FIG. 3 is a perspective view of the folding table of FIG. 1 in the unfolded position.

In one embodiment shown in FIGS. 1 and 3, each swiveling bar is attached to a different one of the subframes. In its folded position, each swiveling bar comes to rest inside a C-shaped stop 10 fastened to the end panel. In its unfolded position, each swiveling bar comes to rest inside the channel 7b on the opposite subframe, thus creating a single frame spanning and supporting the center panels 3. Each swiveling bar is held in place by a locking mechanism 11, which preferably locks the swiveling bar in place automatically with a latch and requires a small manual motion to unlock the bar from the channel. The table in its unfolded position can be seen in FIG. 3.

Attached to each subframe are two foldable legs 12 which, when folded, are approximately parallel with the tube 6 of the subframe, and flat against the end panels 2. Each leg is pivotably attached to the subframe by an axis through a small projection 13 attached to the subframe, and is held in its unfolded position by a slide 14 which, when the leg is folded, lies flat against the end panel. Since one leg, when folded, lies farther from the tube 6 than the other, a small projection 15 enables the slide 14 to operate properly.

When the table is folded, a flexible or stretchable strap 16 held between two posts in the unfolded configuration can be unfastened at one end, wrapped around the folded assembly, then fastened to one of the two posts. Then a handle 17, which can be retractable, can be grasped to carry the folded table.

Figure 4:
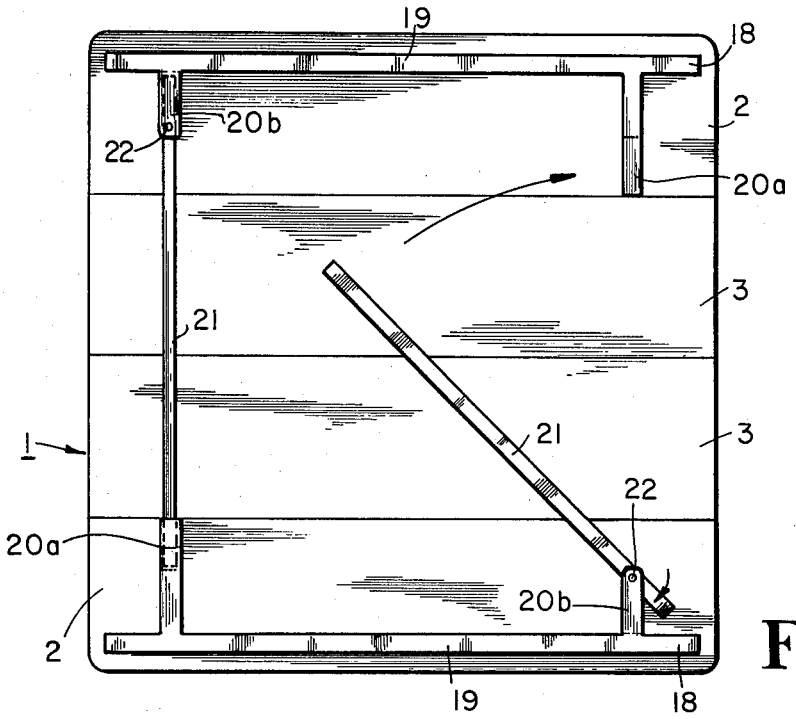
FIG. 4 is a view of the underneath of a foldable table constructed according to the present invention showing, in schematic form, an alternative subframe arrangement.

In another embodiment, shown in FIG. 4, two subframes 18 are attached to the foldable tabletop 1, on the end panels 2. The legs and other hardware are attached as before but since they are similar to those of the previous embodiment, are not shown in FIG. 4. Each subframe comprises a tube 19 following the long edge of the end panels corresponding to the perimeter edge of the unfolded tabletop. Attached to each tube 19, a small distance away from the short edges of the end panel, are two C-shaped channels, 20a and 20b. The open side of 20a faces inward while the open side of 20b faces outward. Two swiveling bars 21 are fastened by pivots 22 to the end of the channels 20b. The motion of the bars is similar to that previously described in the other embodiment, and it is seen that, when in their unfolded position, the bars are held securely by the channels 20a and 20b.

Figure 5:
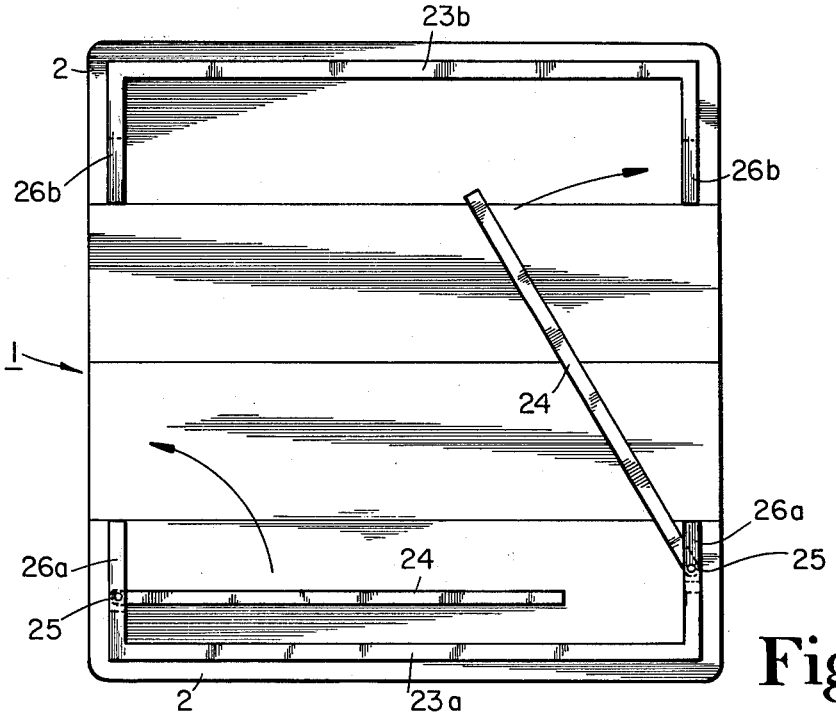
FIG. 5 is a view from the same direction as FIG. 3 showing, in schematic form, another alternative subframe arrangement.

In still another embodiment, shown in FIG. 5, two subframes 23a and 23b are attached to the end panels 2 of the tabletop 1. The legs and other hardware are similar to the previous embodiments and therefore are not shown in FIG. 5. Included in the subframe 23a are two swiveling bars 24, each attached by pivots 25 to the inside of the channels 26a, which point inward. When the bars are in their unfolded positions, they come to rest inside the inward-facing channels 26b on subframe 23b and are held securely by both channels 26a and 26b.

Figure 6:
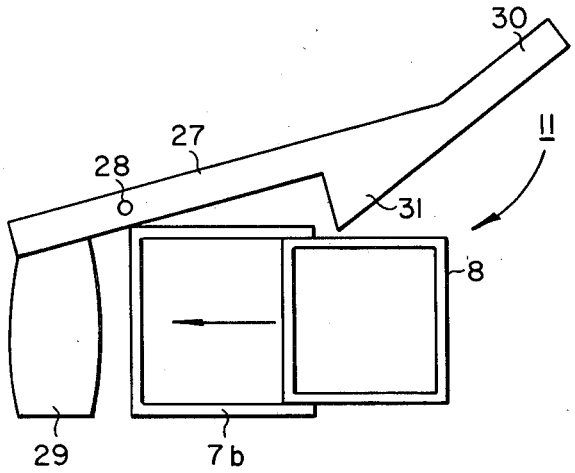
FIG. 6 is an end view of a locking assembly which may be used in various tables constructed according to the present invention.

A detail of locking assembly 11 is shown in the end view of FIG. 6. Locking bar 27 is pivotally attached to C-channel 7b by a pivot pin 28. A rubber member 29 or other spring element urges the closest end upward and the other end downward. When swivel bar 8 is to be engaged with C-channel 16, tab 30 is raised and released after swivel bar 8 engages C-channel 7b. Thereafter, ridge 31 keeps swivel bar 8 in place.

While the present invention has been described in terms of a table with reference to specific embodiments shown in the drawing, it has broader application as a foldable assembly. For example, legs may be omitted and as such it may be employed as a platform. While the panels have been shown and described as being rectangular, they may have other shapes. Further, while the assembly has been shown as folding in the conjunction of FIG. 2A, other folding configurations, such as shown schematically in FIGS. 2B–2D, may be employed. These, and still other modifications, are intended to be within the scope of the present invention defined by the following claims.

What I claim is:

1. A foldable assembly comprising:

first and second substantially planar and rectangular panels each having respective first and second short sides and respective first and second long sides;

means for foldably joining said first and second panels so that said panels may be selectively placed in a folded configuration or in an unfolded configuration in which their planes are substantially coplanar;

said means for foldably joining said first and second panels joining said panels so that said second long side of said first panel is joined to said first long side of said second panel, said first short sides are in substantial alignment and said second short sides are in substantial alignment;

a first subassembly attached to said first panel proximate said first long side hereof;

a second subassembly attached to said second panel proximate said second long side hereof;

said first subassembly having first and second channel portions each with a generally C-shaped cross-section proximate said first and second short sides, respectively, of said first panel;

said second subassembly having first and second channel portions each with a generally C-shaped cross-section proximate said first and second short sides, respectively, of said second panel;

first and second bar members each having first and second ends; means for pivotably attaching said first end of said first bar member within said first C-shaped channel portion of said first subassembly so that said first bar member may be rotated in a plane substantially parallel to said plane of said first panel from a storage position when said panels are in said folded configuration to a support position in which said second end of said first bar member is received within said first C-shaped channel portion of said second assembly so that said first bar member spans between said first and second subassemblies when said panels are in said unfolded configuration; and means for pivotably attaching said first end of said second bar member within said second C-shaped channel portion of one of said first and second subassemblies so that said second bar member may be rotated in a plane substantially parallel to said plane of the respective one of said first and second panels from a storage position when said panels are in said folded configuration to a support position in which said second end of said second bar member is received within said second C-shaped channel portion of the other one of said first and second subassemblies so that said second bar member spans between said first and second subassemblies when said panels are in said unfolded configuration.

2. The assembly recited in claim 1 wherein: said means for foldably joining said first and second panels includes at least a third substantially planar and rectangular panel having respective first and second short sides and respective first and second long sides and means for foldably joining said third panel between said first and second panels so that said second long side of said first panel is joined to said first long side of said third panel, said second long side of said third panel is joined said first long side of said second panel, said first short sides of all of said panels are in substantial alignment and said second short sides of all of said panels are in substantial alignment and so that in said unfolded configuration the planes of all of said panels are substantially coplanar.

3. The assembly recited in claim 2 wherein:

said first bar member is substantially contained within the surface area of said first panel in its said storage position; and said second bar member is substantially contained within the surface area of said one of said first and second panels in its said storage position.

4. The assembly recited in claim 3 further including:

at least first, second and third leg members;

means for pivotably attaching said first leg member to said first subassembly so that said first leg member may be selectively rotated in a plane substantially perpendicular to the plane of said first panel;

means for pivotably attaching said second leg member to said first subassembly so that second leg member may be selectively rotated in a plane substantially perpendicular to the plane of said first panel; and means for pivotably attaching said third leg member to second subassembly so that third leg member may be selectively rotated in a plane substantially perpendicular to said second panel.

5. The assembly recited in claim 4 further including:

a fourth leg member;

means for pivotably attaching said fourth leg member to said second subassembly so that said fourth leg member may be selectively rotated in a plane substantially perpendicular to the plane of said second panel; and wherein said means for pivotably attaching said first leg member to said first subassembly includes means for pivotably attaching said first leg member to a first axis substantially parallel to said respective first short side proximate a first corner between said respective first short side and said respective first long side;

means for pivotably attaching said second leg member to said first subassembly includes means for pivotably attaching said second leg member to a second axis substantially parallel to said respective second short side proximate a second corner between said respective first long side and said respective second short side;

said means for pivotably attaching said third leg member to said second subassembly includes means for pivotably attaching said third member to a third axis substantially parallel to said respective first short side proximate a third corner between said respective first short side and said respective second long side;

said means for pivotably attaching said fourth leg member to said second subassembly includes means for pivotably attaching said fourth leg member to a fourth axis substantially parallel to said respective second side proximate a fourth corner between said respective second long side and said respective second short side;

said means for pivotably attaching said first bar member to said first subassembly includes means for pivotably attaching said first bar member to a fifth axis substantially perpendicular to the plane of said first panel proximate said first corner but further toward said respective second long side than said first axis; and said means for pivotably attaching said second bar member to one of said first and second subassemblies includes means for pivotably attaching said second bar member to a sixth axis substantially perpendicular to the respective plane of said one of said first and second panels subassembly proximate the respective one of said second and fourth corners but further toward said respective one of second and first long sides than said respective one of said second and fourth axes.

6. The assembly recited in claim 5 wherein:

said sixth axis is proximate said fourth corner but further toward said respective first long side than said fourth axis.

7. The assembly recited in claim 5 wherein:

said sixth axis is proximate said second corner but further toward said respective second long side than said second axis.

8. The assembly recited in claim 5, 6 or 7 wherein:

the lengths of all the long sides are equal; and the sum of the lengths of said first short sides of all of said panels is substantially equal to the length of the long sides of any of said panels.

* * * * *